US007597592B2

(12) United States Patent
Dunstan et al.

(10) Patent No.: US 7,597,592 B2
(45) Date of Patent: Oct. 6, 2009

(54) AUTOMATIC CONFIGURATION OF AN INTERFACE TO A HOST OR CLIENT

(75) Inventors: Robert A. Dunstan, Forest Grove, OR (US); Gary Solomon, Acton, MA (US); Bradley Saunders, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 350 days.

(21) Appl. No.: 11/646,220

(22) Filed: Dec. 27, 2006

(65) Prior Publication Data

US 2008/0160811 A1 Jul. 3, 2008

(51) Int. Cl.
*H01R 29/00* (2006.01)

(52) U.S. Cl. ..... 439/680; 439/955

(58) Field of Classification Search ..... 439/488, 439/491, 955, 188, 680; 710/62, 305, 315; 713/300

See application file for complete search history.

(56) References Cited

U.S. PATENT DOCUMENTS 5,660,567 A * 8/1997 Nierlich et al. ..... 439/620.21
6,056,568 A * 5/2000 Arnett ..... 439/188
6,145,037 A * 11/2000 Sakakibara ..... 710/301
6,963,933 B2 * 11/2005 Saito et al. ..... 710/1
7,298,416 B2 * 11/2007 Uryu ..... 348/372
7,356,715 B2 * 4/2008 Okayasu ..... 713/300
7,484,031 B2 * 1/2009 Tjia ..... 710/313
2006/0224791 A1 * 10/2006 Keppeler ..... 710/62

* cited by examiner

*Primary Examiner*—Neil Abrams
(74) *Attorney, Agent, or Firm*—Buckley, Maschoff & Talwalkar LLC

(57) ABSTRACT

According to some embodiments, systems, methods, and apparatuses are provided to detect a coupling of a first cable plug to a bimodal host receptacle and to configure a function of the bimodal host receptacle based at least in part on a first cable plug, where if the first cable plug's relief is a different shape than a key, the bimodal host receptacle will act in a first function, wherein if the first cable plug's relief is a same shape as the key, then the bimodal host receptacle will act in a second function.

12 Claims, 5 Drawing Sheets

AUTOMATIC CONFIGURATION OF AN INTERFACE TO A HOST OR CLIENT

BACKGROUND

In a point-to-point bus topology, such as a serial interconnect, some devices may act as host devices that provide data while other devices may act as clients that receive data from one or more of the host devices. However, conventional external busses such as a universal serial bus ("USB") maintain a strict host-to-client relationship that allows communication between a host and a client but prevents communication between peers. Accordingly a host cannot communicate directly with another host and a client cannot communicate directly with another client.

A USB On-The-Go ("OTG") specification allows communication between two client devices. The two client devices communicate over a USB OTG cable which includes two different plug configurations (i.e. mini-A and mini-B). The client device to which the mini-A plug is coupled acts as a host and the client device to which the mini-B plug is coupled acts as a client. However, the USB OTG specification does not allow communication between two host devices.

DETAILED DESCRIPTION

The several embodiments described herein are provided solely for the purpose of illustration. Embodiments may include any currently or hereafter-known versions of the elements described herein. Therefore, persons in the art will recognize from this description that other embodiments may be practiced with various modifications and alterations.

Figure 1:
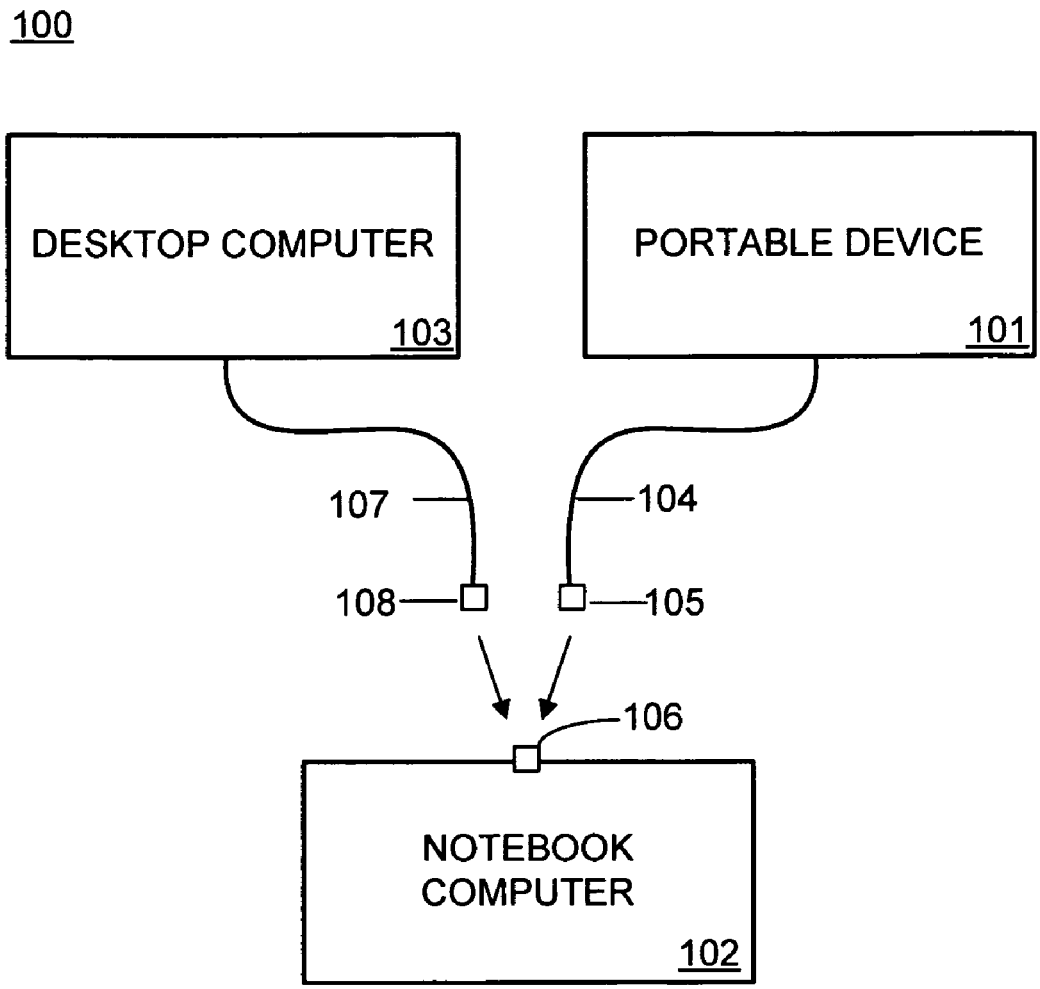
FIG. 1 illustrates a system according to some embodiments.

Now referring to FIG. 1, an embodiment of a system 100 is shown. A portable device 101 may comprise but is not limited to, a personal data assistant, a cell phone, or an MP3 player. A notebook computer 102 is also provided, but may comprise any electrical equipment for performing the methods described herein. A desktop computer 103 may typically function as a host device to provide data and/or services to client devices and may therefore be substituted for any suitable host device in some embodiments.

However, if a user should desire to download files from two devices that comprise host receptacles, such as downloading from a desktop computer 103 to the notebook computer 102 via a USB connection or a Peripheral Component Interconnect Express ("PCIe") connection, not only may a cable comprising two host plugs be required, but a determination as to which device is the host and which is device is the client may need to be made.

In some embodiments of system 100, a cable 104 may comprise a cable plug 105. The notebook 102 may comprise a bimodal host receptacle 106 and a bimodal agent (not shown) to detect a coupling of the cable plug 105 to the bimodal host receptacle 106, and to configure the bimodal host receptacle 106 to function as a client receptacle or a host receptacle based at least in part on the cable plug 105. In the illustrated example, it will be assumed that the bimodal host receptacle 106 is configured to function as a host receptacle based on cable plug 105. Accordingly, the portable device 101 and the notebook computer 102 may communicate as client device and host device, respectively.

A cable 107 may comprise a cable plug 108 in some embodiments of system 100. As stated in the previous example, the notebook 102 may comprise a bimodal host receptacle 106 and the bimodal agent. In the illustrated example, it will be assumed that the bimodal host receptacle 106 is configured to function as a client receptacle based on cable plug 108. Therefore, the desktop computer 103 and the notebook computer 102 may communicate as host device and client device, respectively.

Figure 2:
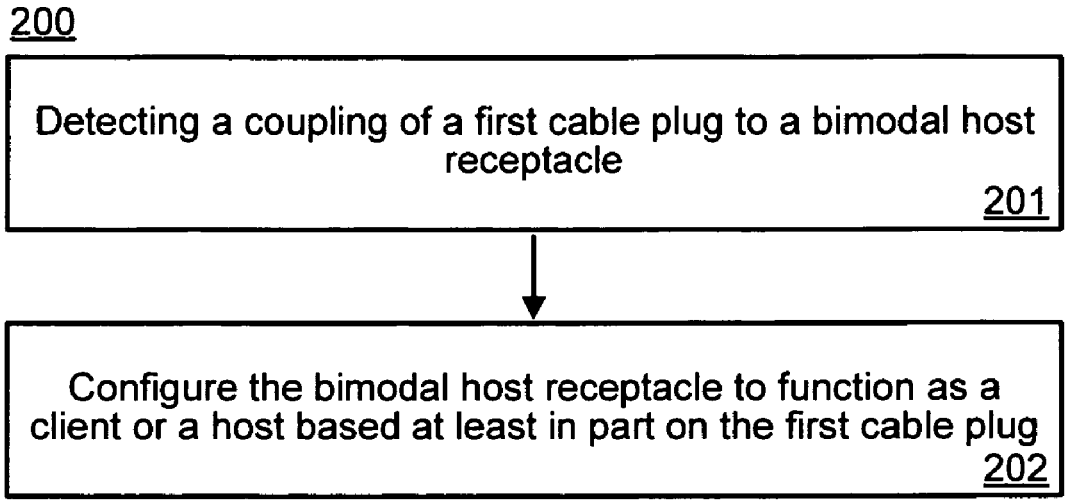
FIG. 2 illustrates a method according to some embodiments.

An embodiment of a method 200 is illustrated at FIG. 2. The method 200 may be executed by any combination of hardware, software, and firmware, including but not limited to, the notebook computer 102 of FIG. 1. Some embodiments of the method 200 may allow peer-to-peer communication between devices that are capable of functioning as host devices.

At 201, a coupling of a first cable plug to a bimodal host receptacle is detected. Detection of the coupling may be based on an electrical signal resulting from, for example, an electrical coupling of the first cable plug coupled to the bimodal host receptacle.

Next, at 202, the bimodal host receptacle is configured to function as a client receptacle or a host receptacle based at least in part on the first cable plug. In some embodiments, configuration of the bimodal host receptacle may be based on receiving an indication to function as a client receptacle or a host receptacle, where the indication and is at least one of a signal, a ground, or a lack of a signal.

In some embodiments, the aforementioned configuration may comprise establishing a communication link between the bimodal host receptacle and a non-transparent bridge. The non-transparent bridge may include a first side and a second side, and the second side of the non-transparent bridge may comprise an intelligent device or processor. Each side of the non-transparent bridge may not be able to determine a device coupled to the other side of the non-transparent bridge. However, each side of the non-transparent bridge may be considered an endpoint that indicates a device or devices that have established a communication link with the non-transparent bridge.

In some embodiments, a client identity may be indicated to the non-transparent bridge in a case that the bimodal host receptacle is configured to function as a client receptacle. For example, if the bimodal receptacle 106 of notebook 102 of FIG. 1 is configured to function as a client receptacle, then an indication may be provided by the non-transparent bridge that indicates the notebook 102 may be a hard drive, an optical drive, or any known device. Providing an indication of a client identity identify to the host device a software driver that may need to be loaded during a hot plug event to communicate with the client receptacle. In some embodiments, configuration of the bimodal host receptacle 202 may be based on a PCIe connection standard.

Figure 3:
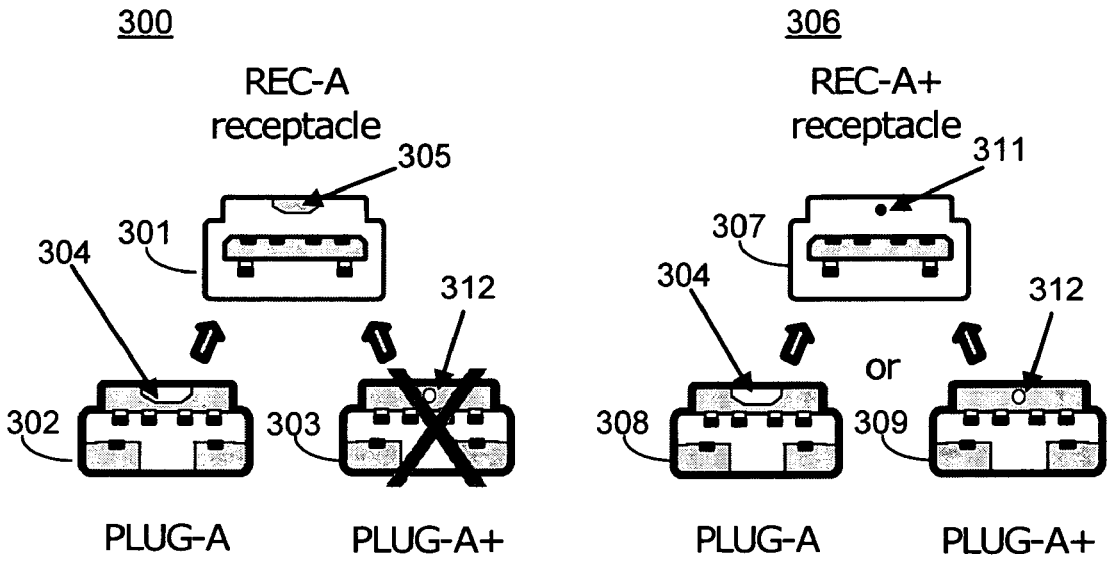
FIG. 3 illustrates a plurality of plugs and receptacles according to some embodiments.

Now referring to FIG. 3, a plurality of plugs and receptacles are shown according to some embodiments. A first plurality of plugs and receptacles 300 may comprise a REC-A receptacle 301, a PLUG-A 302, and a PLUG-A+ 303. In some embodiments, the REC-A receptacle may be a non-bimodal receptacle and may comprise a plurality of electrical contacts and a key 305. For example, in some embodiments the REC-A receptacle may be a PCIe host receptacle, USB host receptacle, a USB2 host receptacle, or a MediaPort host receptacle. In some embodiments, the key 305 may be non-metallic and may protrude from the REC-A receptacle 301.

The PLUG-A 302 may comprise a relief 304 to receive the key 305 and a plurality of contact receptacles to receive the electrical contacts of the REC-A receptacle. In some embodiments, the relief 304 associated with the PLUG-A 302 may be non-electrically coupled with the key 305 such that the REC-A receptacle 301 may be electrically coupled to the PLUG-A 302. The PLUG-A+ 303 may comprise a relief 312 and a plurality of contact receptacles to receive the electrical contacts of the REC-A receptacle 301. However, the relief 312 associated with PLUG-A+ 303 may be of a different shape to receive the key 305 associated with the REC-A receptacle 301 which may prevent the REC-A receptacle 301 from being coupled to the PLUG-A+ 303.

A second plurality of plugs and receptacles 306 may comprise a REC-A+ receptacle 307, a PLUG-A 308, and a PLUG-A+ 312. In some embodiments, the REC-A+ receptacle may be a bimodal host receptacle as described with respect to the method 200 and may comprise a plurality of electrical contacts and a key 311. For example, in some embodiments the REC-A+ receptacle may comprise a modified USB host receptacle, a modified PCIe host receptacle, a modified USB2 host receptacle, or a modified MediaPort host receptacle. In some embodiments, the key 311 may be metallic and may protrude from the REC-A receptacle 311. In some embodiments, the key 311 may be a bimodal indication pin or a switch.

The PLUG-A+ 309 may comprise a relief 312 and a plurality of contact receptacles to receive the electrical contacts of the REC-A+ receptacle 307. In some embodiments, the relief 312 associated with the PLUG-A+ 309 may be electrically coupled to key 311 such that the REC-A+ receptacle 311 may be coupled to the PLUG-A+ 309. The PLUG-A 308 may comprise a relief 304 to receive the key 311 and a plurality of contact receptacles to receive the electrical contacts of the REC-A+ receptacle 307. The relief 304 associated with PLUG-A 308 may be capable of receiving key 311 associated with the REC-A receptacle 301 but may not be electrically coupled to the REC-A+ receptacle 307. Operation of the connectors 306 in conjunction with some embodiments will be described below with respect to FIG. 5

Figure 4:
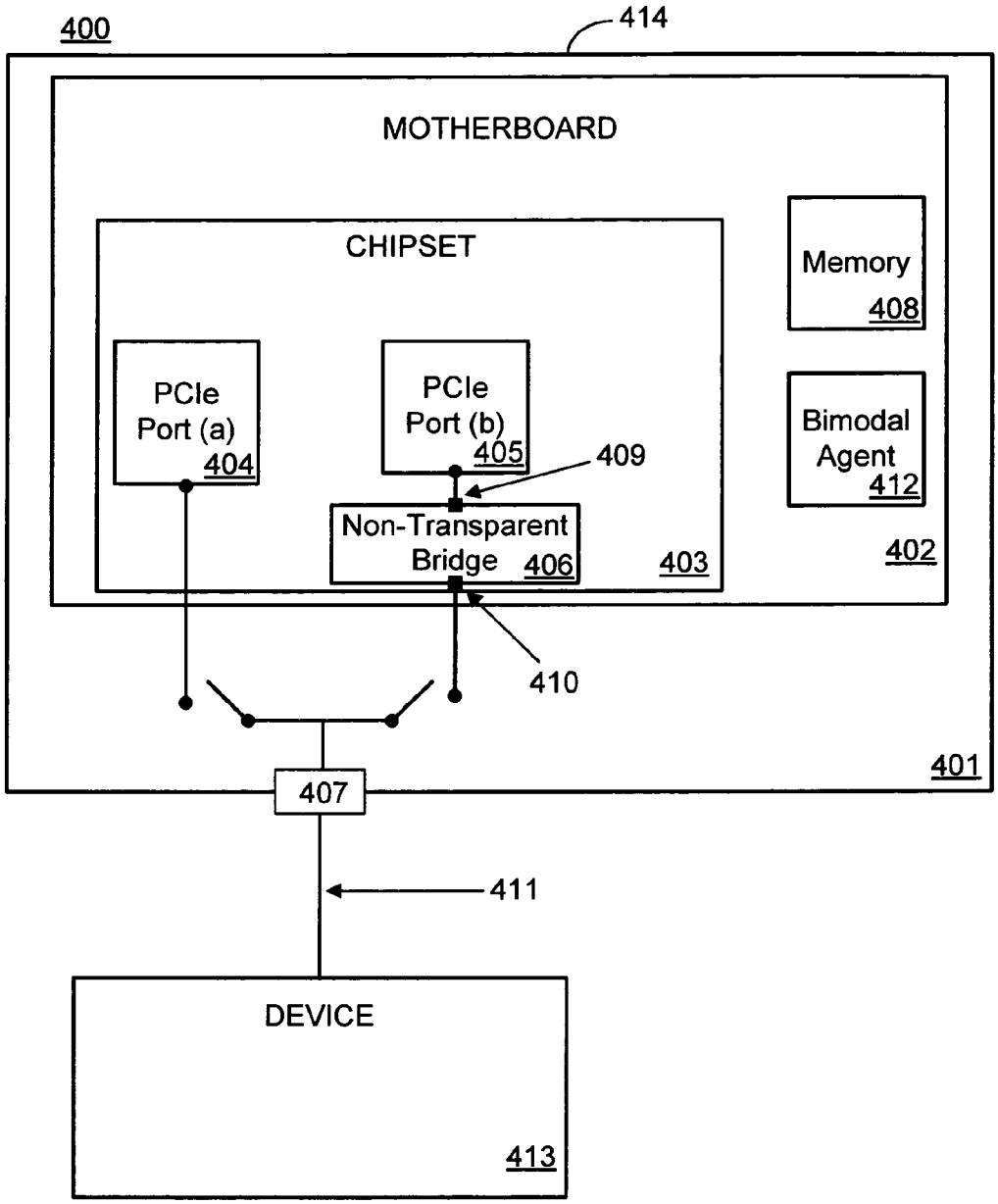
FIG. 4 illustrates a system according to some embodiments.

An embodiment of a system 400 is illustrated in FIG. 4. The system 400 may comprise a device 414 and a device 413. Device 414 comprises a chassis 401 housing a motherboard 402.

The motherboard 402 may comprise a chipset 403, a bimodal agent 412, and a memory 408. The memory 408 may store, for example, applications, programs, procedures, and/or modules that store instructions to be executed. The memory 408 may comprise, according to some embodiments, any type of memory for storing data, such as a Single Data Rate Random Access Memory (SDR-RAM), a Double Data Rate Random Access Memory (DDR-RAM), or a Programmable Read Only Memory (PROM).

The bimodal agent 412 may be implemented in hardware, software, or firmware and may comprise one or more processors, chipsets, or memory modules. Generally, the bimodal agent 412 may detect a coupling of a first cable plug to a bimodal host receptacle, and may configure the bimodal host receptacle to function as a client receptacle or a host receptacle based at least in part on the first cable plug. Operation of the bimodal agent according to some embodiments will be described below.

The chipset 403 may comprise a first PCIe port 404, a second PCIe port 405, and a non-transparent bridge 406 including a first endpoint 409 and a second endpoint 410. In some embodiments, the first PCIe port 404 and the second PCIe port 405 may comprise logical PCI-PCI bridge structures that may provide one or more services, including, but not limited to, hot plug support, power management event support, advanced error reporting support, and virtual channel support.

The chassis 401 of device 414 may comprise a bimodal receptacle 407 and may be coupled to the device 413 via a cable 411 and the bimodal receptacle 407. In some embodiments, the device 413 may comprise any electrical device such as, but not limited to, an MP3 player, a notebook computer, a desktop computer, or a cell phone. The cable 411 may include two host cable plugs. For example, in some embodiments, one cable plug may comprise a PLUG-A 308 and one cable plug may comprise a PLUG-A+ 309 as described with respect to FIG. 3. In some embodiments, both cable plugs of cable 411 may each be a PLUG-A+ 309.

Figure 5:
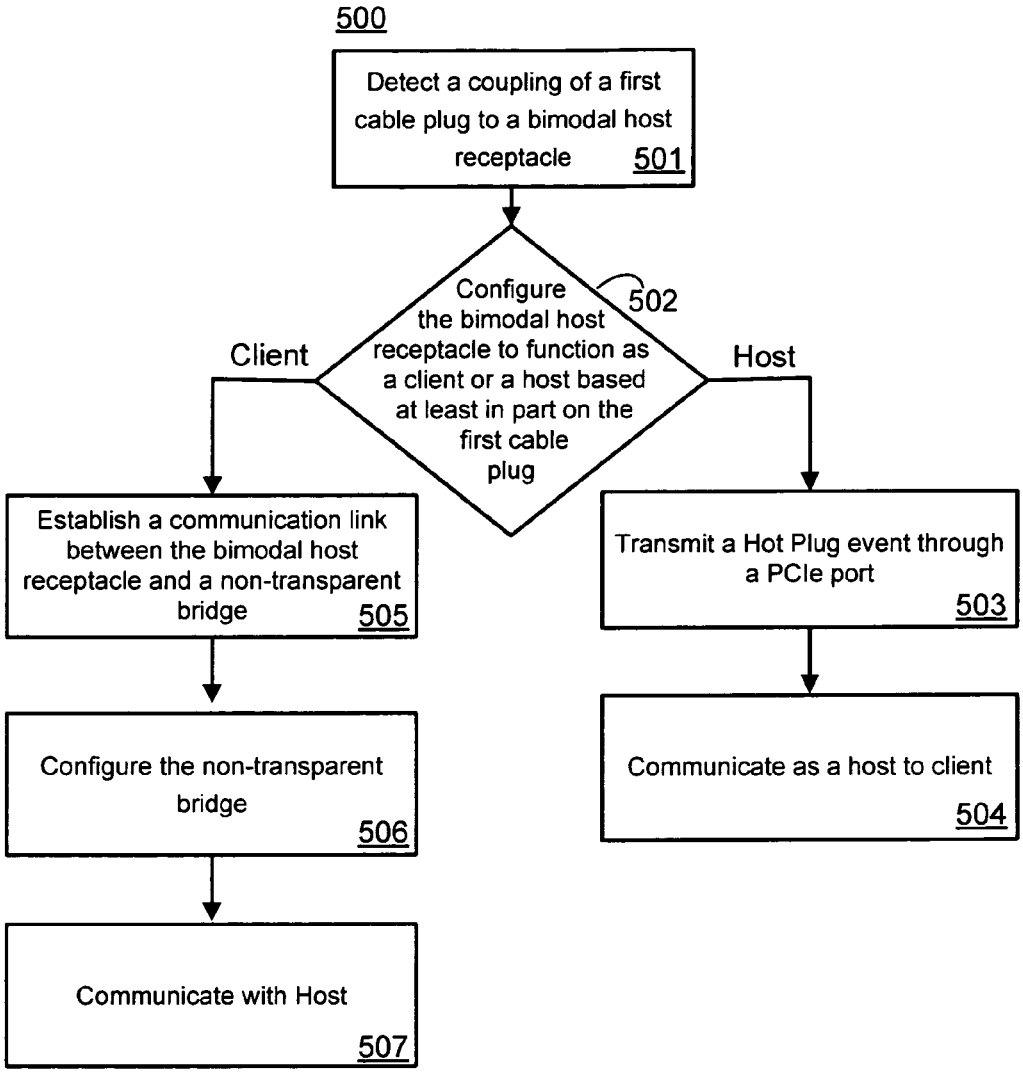
FIG. 5 illustrates a process according to some embodiments.

FIG. 5 illustrates an embodiment of a process 500. The process 500 may be executed by any combination of hardware, software, and firmware, including but not limited to the system 500 of FIG. 5. Some embodiments of the process 500 may allow peer-to-peer communication between devices that comprise host receptacles. In some embodiments, the process 500 may illustrate a reconfiguration of a bi-modal host receptacle based on a type of plug detected at a REC-A+ receptacle as described with respect to FIG. 3.

At 501, a coupling of a first cable plug to a bimodal host receptacle is detected. The coupling may be detected by a bimodal agent based on an electrical signal occurring as a result of the first cable plug being electrically coupled to the bimodal host receptacle. For example, a cable inserted into the bimodal host receptacle 407 may initiate an electrical signal being sent to the bimodal agent 412. However, in some embodiments, a cable inserted into the bimodal receptacle 407 may not initiate an expected electrical signal and thus a lack of a signal may be detected by the bimodal agent at 501.

Next, at 502, a determination is made to configure the bimodal host receptacle to function as a client receptacle or a host receptacle based at least in part on the first cable plug. In some embodiments, a bimodal agent may configure the bimodal host receptacle to function as a client receptacle or a host receptacle. For example, if the first cable plug is a PLUG-A+ 309 and is coupled to the REC-A+ receptacle 307 of FIG. 3, then, in some embodiments, the configuration at 502 may be based on an indication that is created when key 311 is electrically coupled to the relief 312. The indication may comprise at least one of a signal, a ground, or a lack of a signal. In some embodiments the bimodal agent may not be required to be reset to make the determination.

If a determination at 502 is to configure the bimodal host receptacle to function as a host receptacle, then at 503 a hot plug event may be transmitted to the host from a client through a port, such as a PCIe port 404. Transmitting the hot plug event to the host may launch an application associated with the client. Next, at 504 the host may communicate to the client.

However, if the determination at 502 is to configure the bimodal host receptacle to function as a client receptacle, then at 505, a communication link between the bimodal host receptacle and a non-transparent bridge may be established. For example, and referring to FIG. 4, an electrical connection between the bimodal receptacle 407 and the PCIe port 404 may be opened and an electrical connection between the bimodal host receptacle 407 and the second endpoint 410 of the non-transparent bridge 406 may be established.

Next, at 506, a non-transparent bridge may be configured. In some embodiments, the configuring may be based on receiving an indication to function as a client receptacle or a host receptacle. The configuring may comprise establishing a communication link between the receptacle and a non-transparent bridge. In some embodiments, a client identity may be indicated to the non-transparent bridge in a case that the bimodal host receptacle is configured to function as a client receptacle.

In some embodiments, the bimodal agent may be configured at power up, may configure the non-transparent bridge, and may provide a signal indicating that the bimodal agent is communicating with the non-transparent bridge. Thus, when a cable plug associated with a client, such as, but not limited to a PLUG-A+, is inserted into a bimodal receptacle, a data path may be established between an end point of an already-configured and operational non-transparent bridge and a bimodal host receptacle. When configured as a client receptacle, a hot plug event may be transmitted to a host receptacle of a corresponding device that may discover a PCIe endpoint presented to it by the non-transparent bridge. For example, the host receptacle of the corresponding device may be presented with a PCIe endpoint that indicates the client is a hard drive that requires a specific driver in order to be accessed.

Next, at 507, the receptacle may be used to communicate with a host. For example, the bimodal receptacle 407 may receive information from a host and communicate with the PCIe port 405 via the non-transparent bridge 406.

The foregoing has been described with reference to specific embodiments. It will, however, be evident that various modifications and changes may be made thereto without departing from the broader spirit and scope set forth in the appended claims.

The invention claimed is:

1. A method comprising:

detecting a coupling of a first cable plug to a bimodal host receptacle, wherein the first cable plug comprises a relief, wherein the bimodal host receptacle comprises a first portion and a second portion, wherein the first portion comprises a plurality of connection pins arranged in a line, and wherein the second portion comprise a key that is offset from the plurality of connection pins; and configuring a function of the bimodal host receptacle based at least in part on the first cable plug, wherein if the first cable plug's relief is a different shape than the key, the bimodal host receptacle will act in a first function, and wherein if the first cable plug's relief is a same shape as the key, then the bimodal host receptacle will act in a second function; and receiving an indication to function as a client receptacle or a host receptacle, wherein the indication is dependent on which one of said shape is detected and is at least one of a signal, a ground, or a lack of a signal.

2. The method of claim 1, wherein configuring the bimodal host receptacle is based on a PCI Express connection standard.

3. The method of claim 1, wherein the first portion is wider than the second portion, and wherein the first portion is taller than the second portion.

4. An apparatus comprising:

a bimodal host receptacle, wherein the bimodal host receptacle comprises a first portion and a second portion, wherein the first portion comprises a plurality of connection pins arranged in a line, wherein the second portion comprise a key that is offset from the plurality of contacts; and a bimodal agent to detect a coupling of a first cable plug to the bimodal host receptacle, and to configure a function of the bimodal host receptacle based at least in part on the first cable plug, wherein the first cable plug comprises a relief, wherein if the first cable plug's relief is a different shape than the key then the bimodal host receptacle will act in a first function, and wherein if the first cable plug's relief is a same shape as the key, then the bimodal host receptacle will act in a second function, wherein the bimodal indication pin provides an indication to the bimodal agent to determine if the apparatus is a host or a client, wherein the indication is at least one of a signal, a ground, or a lack of a signal.

5. The apparatus of claim 4, wherein the key comprises a bimodal indication pin.

6. The apparatus of claim 5, wherein the first cable plug comprises a non-bimodal plug and is to be coupled to the bimodal host receptacle, wherein the bimodal indication pin is to be non-electrically coupled to a relief of a non-bimodal plug.

7. The apparatus of claim 5, wherein the first cable plug is a bimodal plug and is to be coupled to the bimodal host receptacle, wherein the bimodal indication pin is to be electrically coupled to an electrical contact of the bimodal plug.

8. The apparatus of claim 4, wherein the first portion is wider than the second portion, and wherein the first portion is taller than the second portion.

9. A system comprising:

a first device comprising a first cable plug, wherein the first cable plug comprises a relief, and wherein the first cable plug is at least one of a bimodal host receptacle or a non-bimodal host receptacle; and a second device comprising:

a double data rate memory module;

a bimodal host receptacle, wherein the bimodal host receptacle comprises a first portion and a second portion, wherein the first portion comprises a plurality of connection pins arranged in a line, wherein the second portion comprise a key that is offset from the plurality of contacts; and a bimodal agent to detect a coupling of a the first cable plug of the first device to the bimodal host receptacle of the second device, and to configure a function of the bimodal host receptacle based at least in part on the first cable plug, wherein if the first cable plug's relief is a different shape than the key, the bimodal host receptacle will act in a first function, and wherein if the first cable plug's relief is a same shape as the key, then the bimodal host receptacle will act in a second function, wherein the bimodal indication pin provides an indication to the bimodal agent to determine if the apparatus is to function as a host receptacle or a client receptacle, wherein the indication is at least of a signal, a ground, or a lack of a signal.

10. The system of claim 9, wherein the key comprises a bimodal indication pin, wherein when the first cable plug is to be coupled to the bimodal host receptacle of the second device, and wherein the bimodal indication pin is to be electrically coupled to an electrical connection of the first cable plug.

11. The system of claim 9, wherein the key comprises a bimodal indication pin, wherein when the first cable plug is to be coupled to the bimodal host receptacle of the second device, and wherein the bimodal indication pin is to be non-electrically coupled to the relief of the first cable plug.

12. The system of claim 9, wherein the first portion is wider than the second portion, and wherein the first portion is taller than the second portion.

* * * * *